US012601571B2

(12) United States Patent
Huang

(10) Patent No.: US 12,601,571 B2
(45) Date of Patent: Apr. 14, 2026

(54) ELECTRONIC SHOOTING TRAINING TARGET

(71) Applicant: Chi Hsiu Huang, Hsinchu City (TW)

(72) Inventor: Chi Hsiu Huang, Hsinchu City (TW)

( * ) Notice: Subject to any disclaimer, the term of this patent is extended or adjusted under 35 U.S.C. 154(b) by 246 days.

(21) Appl. No.: 18/642,857

(22) Filed: Apr. 23, 2024

(65) Prior Publication Data

US 2024/0369329 A1 Nov. 7, 2024

(30) Foreign Application Priority Data

May 2, 2023 (TW) ..... 112116239

(51) Int. Cl.
*F41J 5/056* (2006.01)
*F41J 5/14* (2006.01)

(52) U.S. Cl.
CPC ..... *F41J 5/056* (2013.01); *F41J 5/14* (2013.01)

(58) Field of Classification Search
None
See application file for complete search history.

(56) References Cited

U.S. PATENT DOCUMENTS

| | | | | |
|---|---|---|---|---|
| 8,105,087 | B2 * | 1/2012 | Valentini | F41J 5/056 434/11 |
| 8,523,185 | B1 * | 9/2013 | Gilbreath | F41J 5/14 434/23 |
| 10,190,854 | B2 * | 1/2019 | Gracia Elizondo | F41J 5/02 |
| 10,712,133 | B2 * | 7/2020 | Kerley | F41J 5/14 |
| 11,047,653 | B1 * | 6/2021 | Sender | F41J 5/04 |
| 2016/0370156 | A1 * | 12/2016 | Elizondo | F41J 5/056 |
| 2022/0193513 | A1 * | 6/2022 | Goldberg | A63B 63/004 |
| 2025/0067543 | A1 * | 2/2025 | Jiang | F41J 5/02 |

FOREIGN PATENT DOCUMENTS

| | | |
|---|---|---|
| CN | 201402103 Y | 2/2010 |
| CN | 106500549 A | 3/2017 |
| TW | 174461 | 12/1991 |

* cited by examiner

*Primary Examiner* — Sunit Pandya
(74) *Attorney, Agent, or Firm* — WPAT, PC

(57) ABSTRACT

An electronic shooting training target has a target seat, and multiple target holes penetrate through the target seat. A base plate includes a plate body, multiple triggers and a controller. The base plate is mounted on a rear side of the target seat and positioned at a distance from the rear side. Each of the sensing assemblies has a hollow rod, an elastic part, an impact part, and a screw. The hollow rod is mounted through one of the target holes. The elastic part is sleeved on one end of the hollow rod. The impact part is mounted on the hollow rod. The screw is mounted through another end of the hollow rod and is fixed on the impact part.

16 Claims, 9 Drawing Sheets

ELECTRONIC SHOOTING TRAINING TARGET

BACKGROUND OF THE INVENTION

1. Field of the Invention

The present invention relates to a shooting target, especially to a shooting training target for an airsoft gun.

2. Description of the Prior Arts

To save the consumption of live ammunition in the daily target shooting training, the military and police usually use gas guns or electric air guns equipped with plastic bullets (commonly known as airsoft pellets or BBs), and shoot at targets at a certain distance, such as target paper or fixed targets. For use, the target paper is pre-set at a certain distance, and the target paper is shot at continuously. When the shooting is completed, the paper is then removed to observe the points of impact. The fixed target is a can or balloon set in a specific location, and the bullet will produce a sound or burst phenomenon upon impact to determine whether the target is hit or not. There is even a screen sensor target that can be directly subjected to the bullet impact and displayed on the screen.

However, each of the aforementioned targets has its own disadvantages. The target paper is consumable goods that must be replaced after use and is not environmentally friendly. In addition, after multiple rounds of shooting, there is no way to know the position of each single shot upon hitting the target. The fixed targets will fall off or break after being shot at and have to be recovered or removed by labor, resulting in interruption of shooting training and affecting the training of the shooters, thus lowering the efficiency of shooting training. The screen sensor target is limited to low velocity guns. The screen is prone to damage with high maintenance costs and cannot be used for high velocity simulation toy guns, greatly reducing the practicality of training.

To overcome the shortcomings, the present invention provides an electronic shooting training target to mitigate or obviate the aforementioned problems.

SUMMARY OF THE INVENTION

The main objective of the present invention is to provide an electronic shooting training target having multiple sensing assemblies in the target seat, and the sensing part comprises an impact-resistant impact part to achieve the purpose of withstanding repeated impacts of projectiles from legal simulation toy guns.

The electronic shooting training target has a target seat, a base plate, and multiple sensing assemblies. The target seat comprises a front side and a rear side, and multiple target holes penetrate through the target seat.

The base plate comprises a plate body, multiple triggers, and a controller. The plate body is mounted on the rear side of the target seat and positioned at a distance from the rear side. Each of the triggers is mounted on a side of the plate body adjacent to the target seat. The controller is mounted on the plate body and is electrically connected to each of the triggers.

Each of the sensing assemblies comprises a hollow rod, an elastic part, an impact part, and a screw. The hollow rod is mounted through one of the target holes. The elastic part is sleeved on one end of the hollow rod, one end of the elastic part abuts the front side of the target seat, and each of the hollow rods corresponds in position to a respective one of the triggers. The impact part covers one end of the hollow rod and abuts another end of the elastic part. One end of the screw is mounted through another end of the hollow rod and is fixed on the impact part.

The advantage of the present invention is that the impact part has impact resistance characteristics and therefore can withstand repeated and continuous shooting of legal simulation toy guns and can be reused. The modular structure design and the electronic control system can be adjusted according to the needs of various scenarios with the convenience of customized assembly. Users can determine whether they have hit the target or not through the light emitted from the light transmissive hole, or the light can be emitted beforehand as an indication of the target's position. Because the impact part can withstand high impact, users can use the toy gun with simulated recoil for shooting training. The present invention can further send the hit coordinates back to the tablet or computer for display or storage, provided as teaching and training data for analysis, and do not need assistant staff to assist the training, saving training manpower and time.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
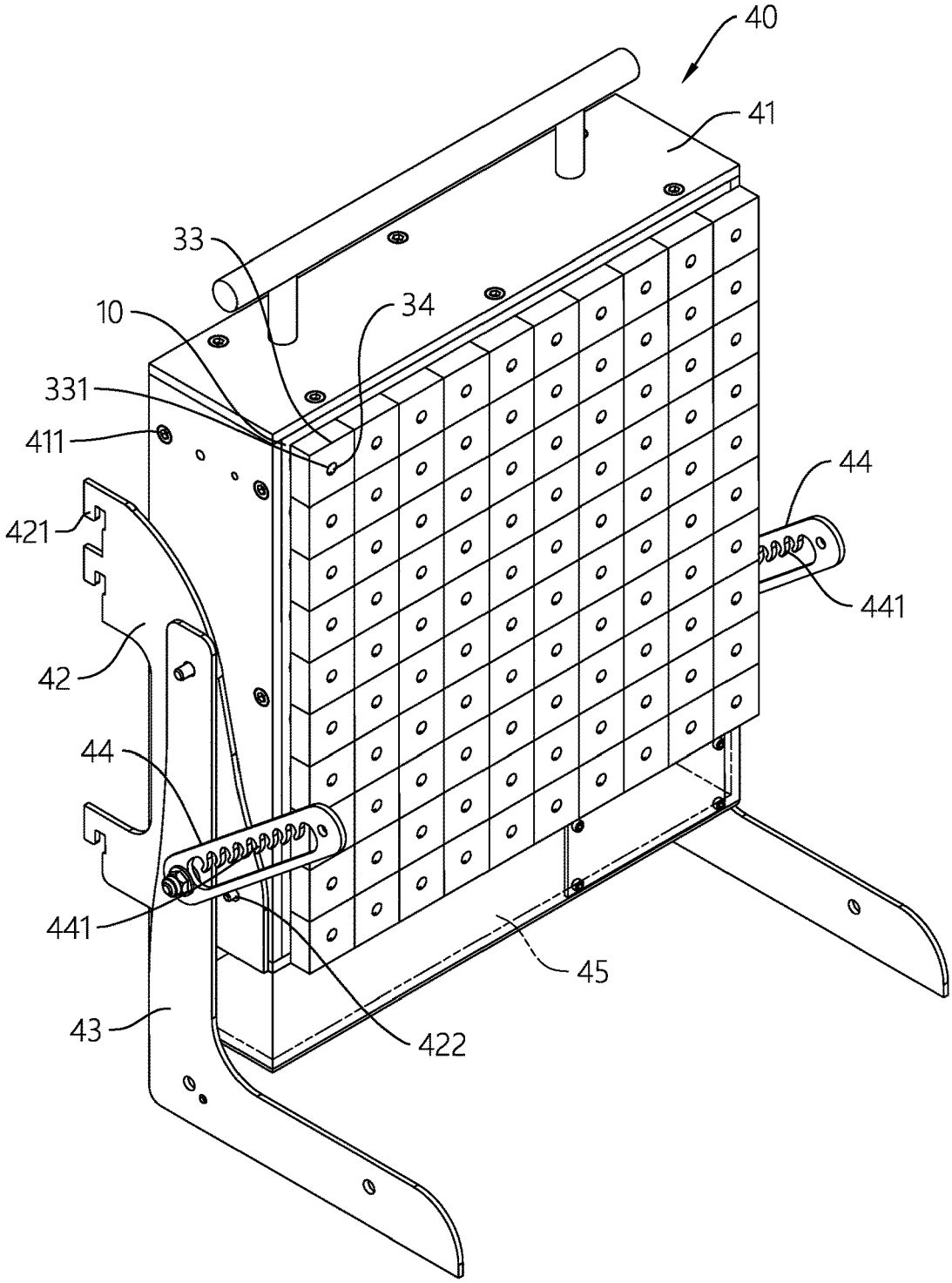
FIG. 1 is a perspective view of an electronic shooting training target mounted on a fixation holder in accordance with the present invention.
Figure 3:
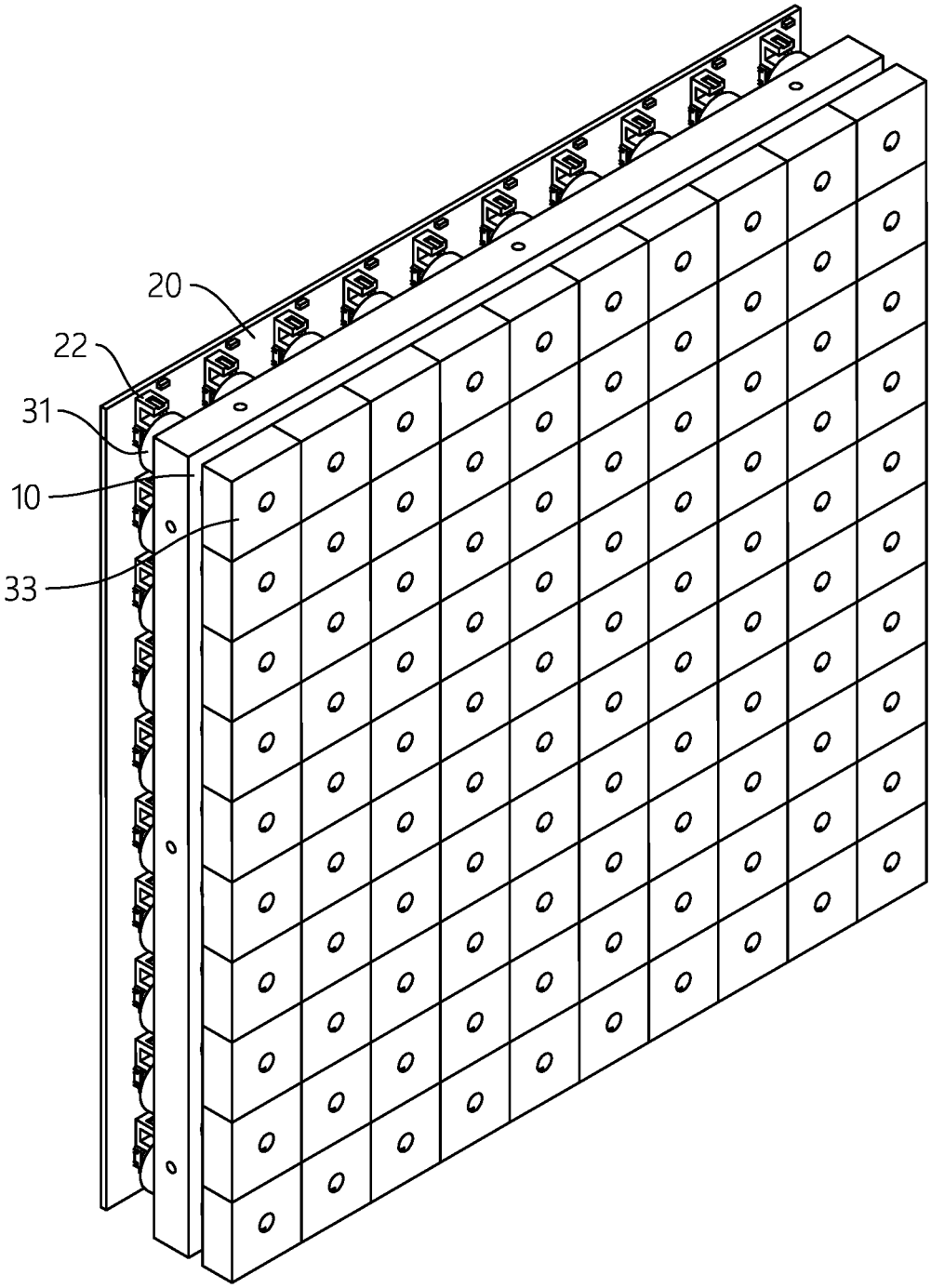
FIG. 3 is a perspective view of the electronic shooting training target in FIG. 1.
Figure 4:
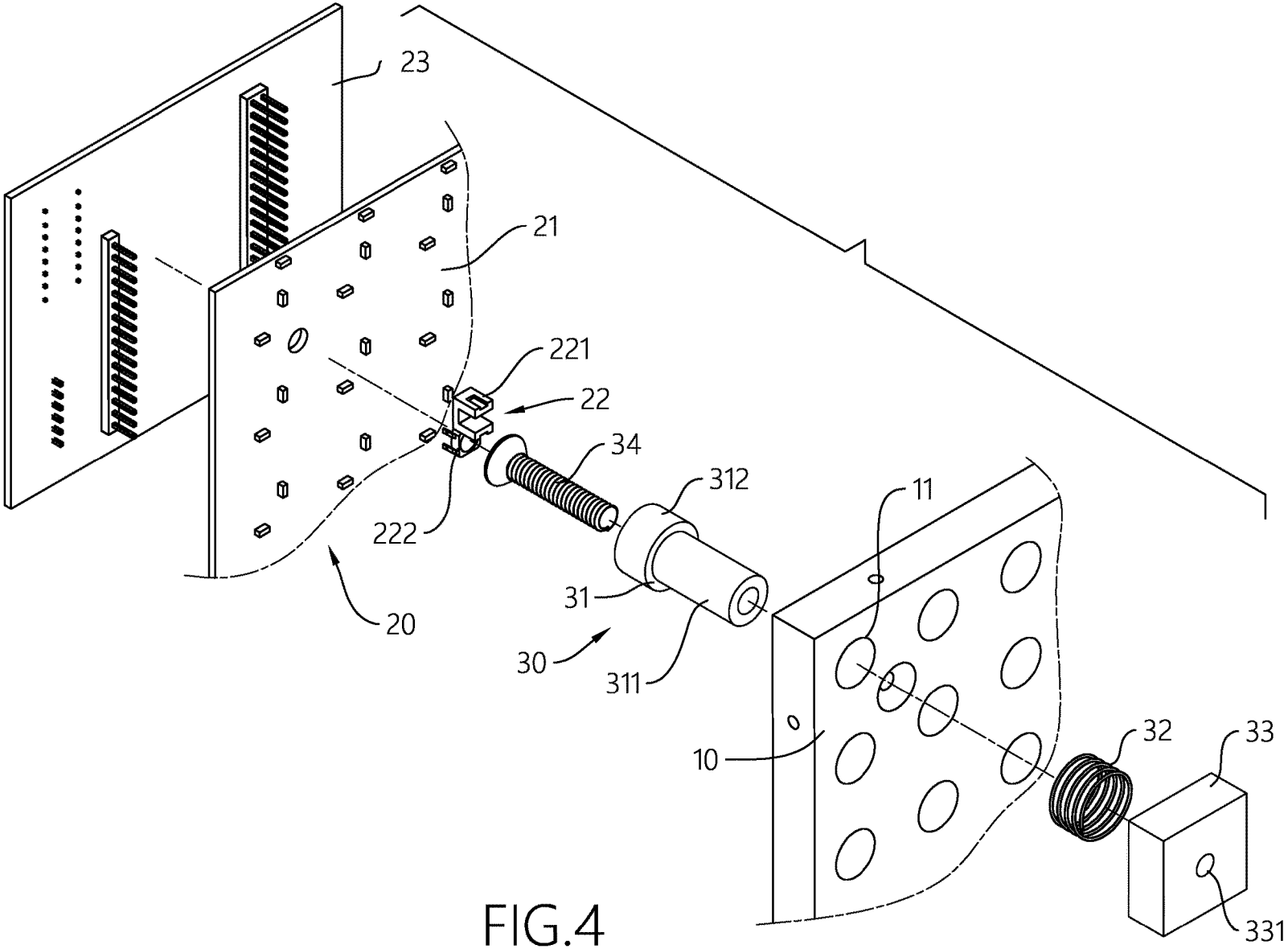
FIG. 4 is an exploded view of main components of the electronic shooting training target in FIG. 1.

With reference to FIG. 1, FIG. 3 and FIG. 4, an electronic shooting training target in accordance with the present invention comprises a target seat 10, a base plate 20, and multiple sensing assemblies 30.

Figure 5:
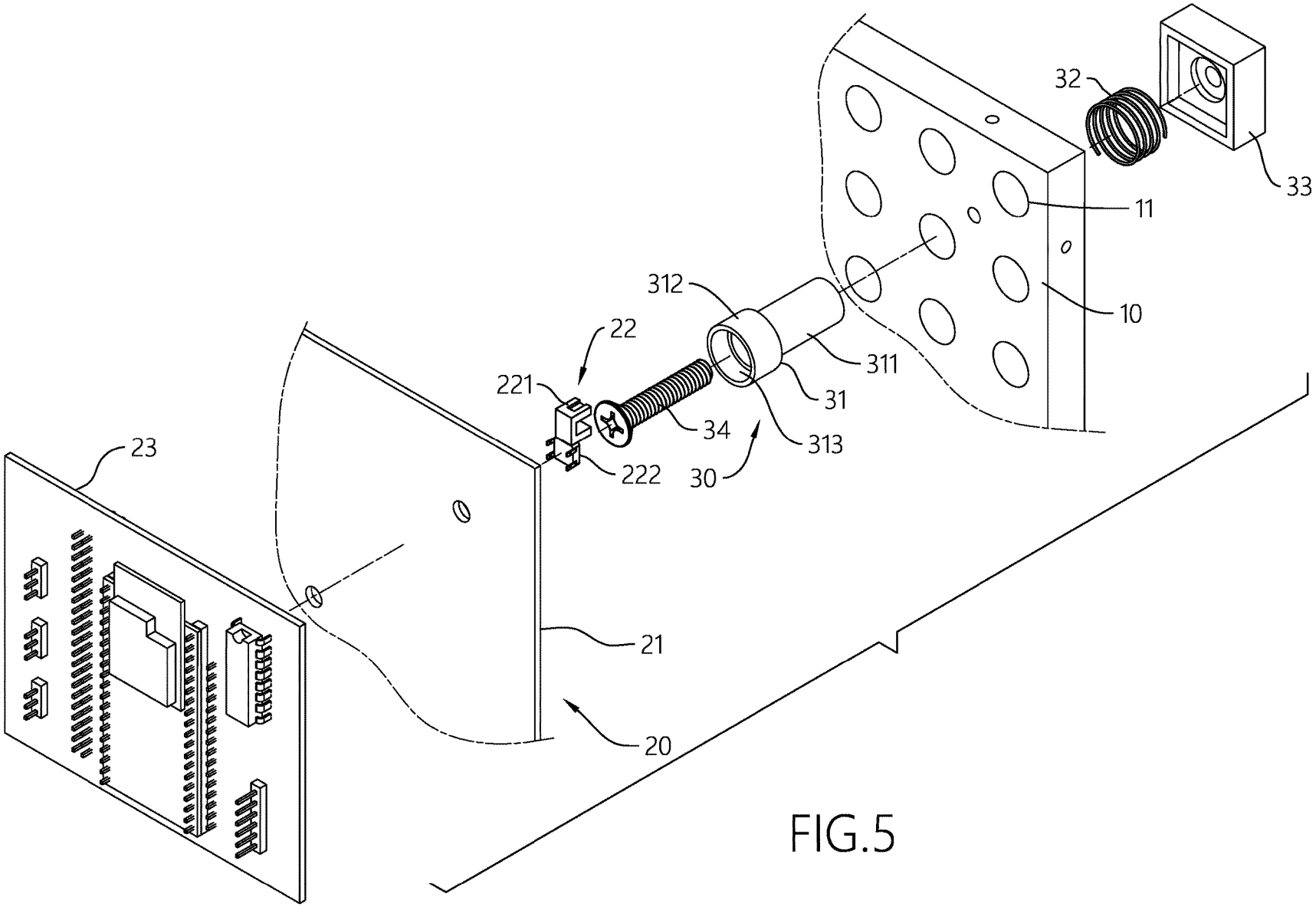
FIG. 5 is an exploded view of the main components of the electronic shooting training target in FIG. 1.

With reference to FIG. 3 to FIG. 5, the target seat 10 is a sheet comprising a front side and a rear side, and the front side and the rear side are two opposite sides. The target seat 10 comprises multiple target holes 11, and the target holes 11 penetrate through the target seat 10. In this embodiment, the target seat 10 is made of metal, such as an aluminum plate, but it is not limited thereto, as the material of the target seat 10 can be changed according to needs.

With reference to FIG. 3 to FIG. 6, the base plate 20 comprises a plate body 21, multiple triggers 22 and a controller 23. The plate body 21 is a circuit board, and the plate body 21 is mounted on the rear side of the target seat 10 and positioned at a distance from the rear side. Each of the triggers 22 is mounted on a surface of the plate body 21, and the surface of the plate body 21 is adjacent to the target seat 10. In this embodiment, each of the triggers 22 comprises a sensor 221 and an LED luminous part 222. The LED luminous part 222 is of a full-color specification, the sensor 221 and the LED luminous part 222 are conventional components, and detailed structure thereof will be omitted from description. The sensor 221 and the LED luminous part 222 are grouped and mounted in an array on the plate body 21. The controller 23 is mounted on the plate body 21, the controller 23 is a conventional micro-computerized control device, and the detailed structure of the controller 23 will be omitted from description. The sensor 221, the LED luminous part 222, the controller 23, and the plate body 21 are electrically connected to each other, but it is not limited thereto. In another embodiment, the electronic shooting training target may not have the LED luminous part 222.

Each of the sensing assemblies 30 comprises a hollow rod 31, an elastic part 32, an impact part 33 and a screw 34. The hollow rod 31 comprises a front end 311 and a rear end 312, and the front end 311 and the rear end 312 are opposite each other. The outer diameter of the front end 311 is smaller than the outer diameter of the rear end 312, and the axial length of the front end 311 is greater than the thickness of the target seat 10. A slot 313 is concavely formed on the surface of the rear end 312. The front end 311 of the hollow rod 31 is mounted through the target hole 11 from the rear side of the target seat 10. The elastic part 32 is a compression spring and is sleeved on the front end 311 of the hollow rod 31, and one end of the elastic part 32 abuts the front side of the target seat 10. A light transmissive hole 331 penetrates through the impact part 33 and is formed with internal threads. The impact part 33 is covered at the front end 311 of the hollow rod 31 and abuts another end of the elastic part 32. The impact part 33 is made of metal, e.g. stainless steel, but it is not limited thereto, and the impact part 33 may not have the light transmissive hole 331. The screw 34 is made of a plastic, transparent and light-conducting material. The screw 34 is mounted through the slot 313 of the hollow rod 31 and out of the front end 311, and is fastened to the light transmissive hole 331 of the impact part 33. Each of the hollow rods 31 corresponds in position to a respective one of the triggers 22, so that each of the hollow rods 31 can trigger the trigger 22, but it is not limited thereto, as the screw 34 may not have the light-conducting function.

Figure 2:
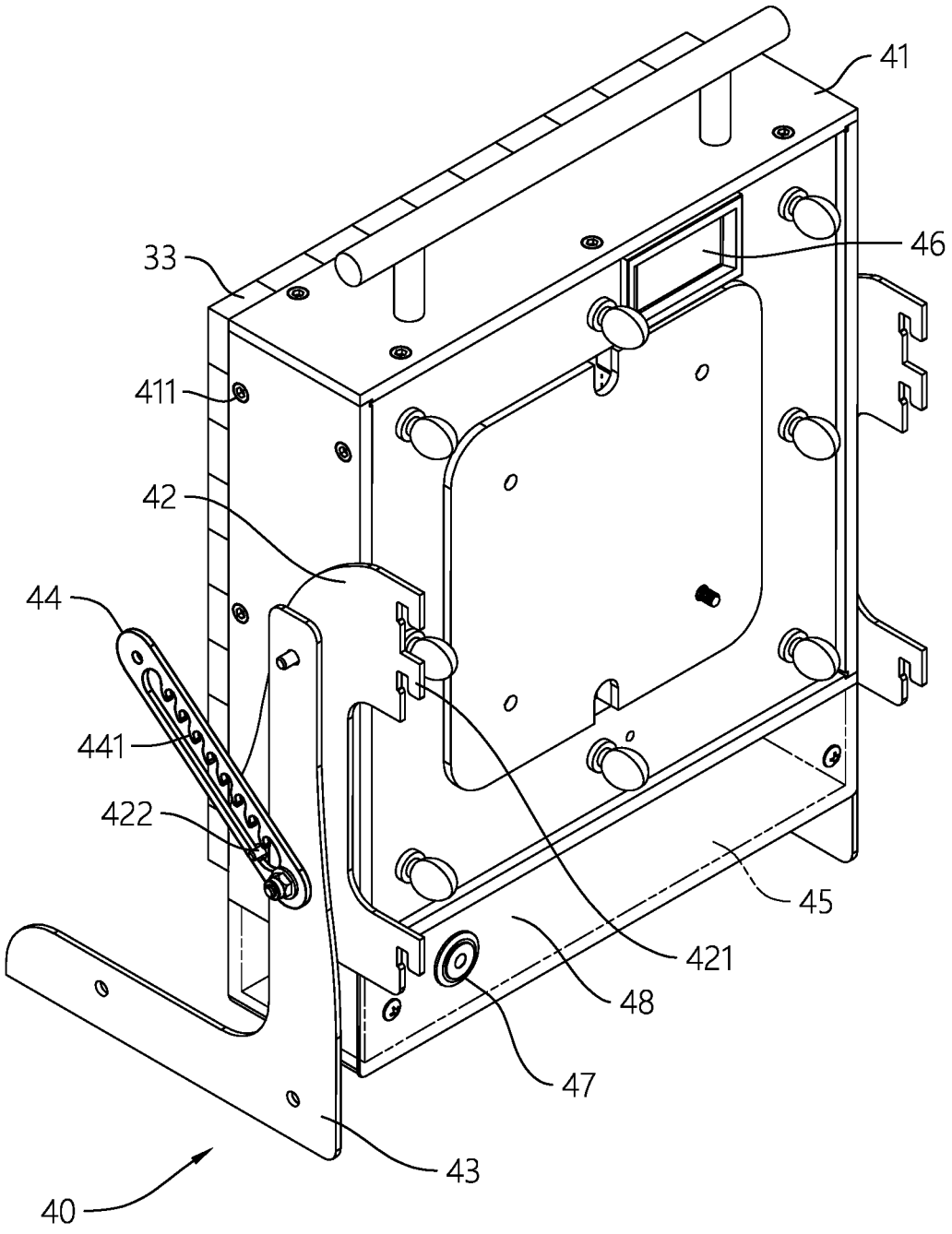
FIG. 2 is a perspective view of the electronic shooting training target mounted on the fixation holder in FIG. 1.

When the present invention is used, please refer to FIG. 1 and FIG. 2, to illustrate that a user may install a single set of the present invention onto a fixation holder 40, but it is not limited thereto. Precisely, the fixation holder 40 comprises a mounting base 41, two wall hanging pieces 42, two support members 43, two angle adjusters 44 and a battery box assembly 45. The mounting base 41 comprises a storage area, and multiple screw holes 411 are formed on the sidewall surfaces of the mounting base 41. Each of the two wall hanging pieces 42 has multiple hooks 421 and multiple lock holes 422 formed thereon, and the two wall hanging pieces 42 are respectively secured on the opposite sidewall surfaces of the mounting base 41. Each of the two support members 43 has one end pivotally connected to a respective one of the opposite sidewall surfaces of the mounting base 41. The angle adjusters 44 are sheets, each of the angle adjusters 44 forms multiple tooth parts 441, and the multiple tooth parts are arranged in a direction extending toward the two ends of the angle adjuster 44. One end of the angle adjuster 44 is pivoted on the support member 43. Users can change the relative positions of the support member 43 and the angle adjuster 44 by locking the support member 43 and angle adjuster 44 with multiple fixing elements to change the tilting angle of the mounting base 41 according to demand; this is a conventional application and will be omitted from description. The present invention is securely mounted on the mounting base 41, and then the users hang the fixation holder 40 on the wall, completing the setup of the electronic shooting training target. A battery box assembly 45 is mounted on the mounting base 41 and comprises a digital electricity meter 46, a starting switch 47, a battery (not shown in figures) and a battery box cover 48. The digital electricity meter 46 and the starting switch 47 are electrically connected to the battery, and the battery box cover 48 covers the battery. The aforementioned batteries can be used together with batteries in electric guns (e.g. lithium batteries), and one or two sets of the batteries can be used in series to extend duration of use, as the power supply of the present invention, and can be connected to a tablet or a computer through Wi-fi for use in compliance with the software.

Figure 6:
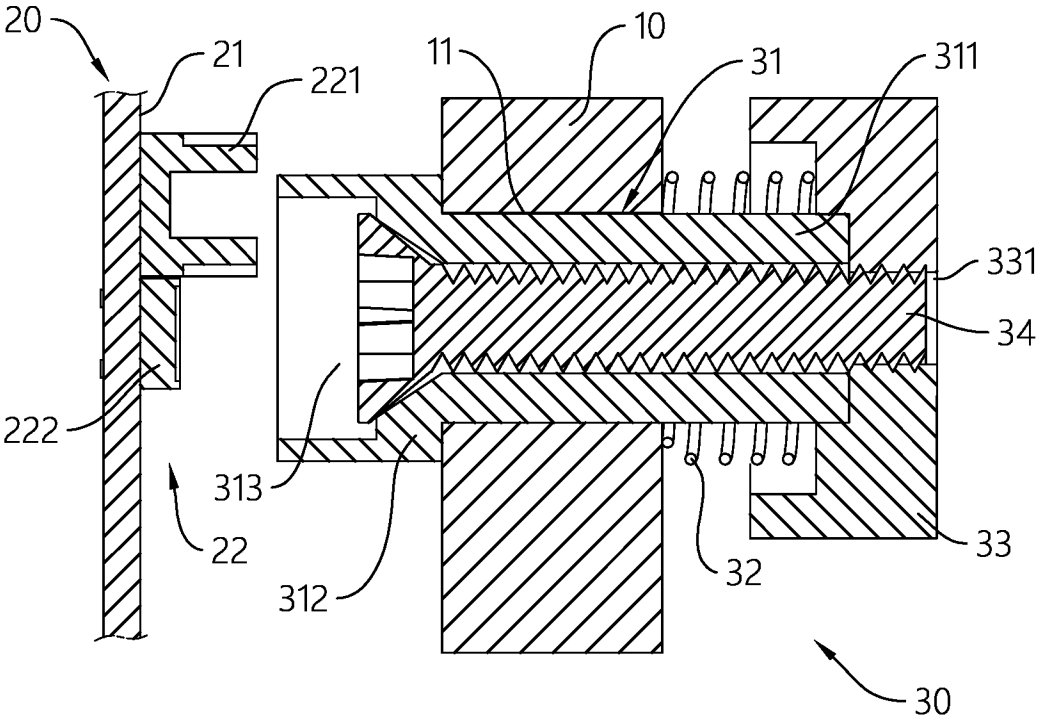
FIG. 6 is a partial cross-sectional view of the electronic shooting training target in FIG. 1.
Figure 7:
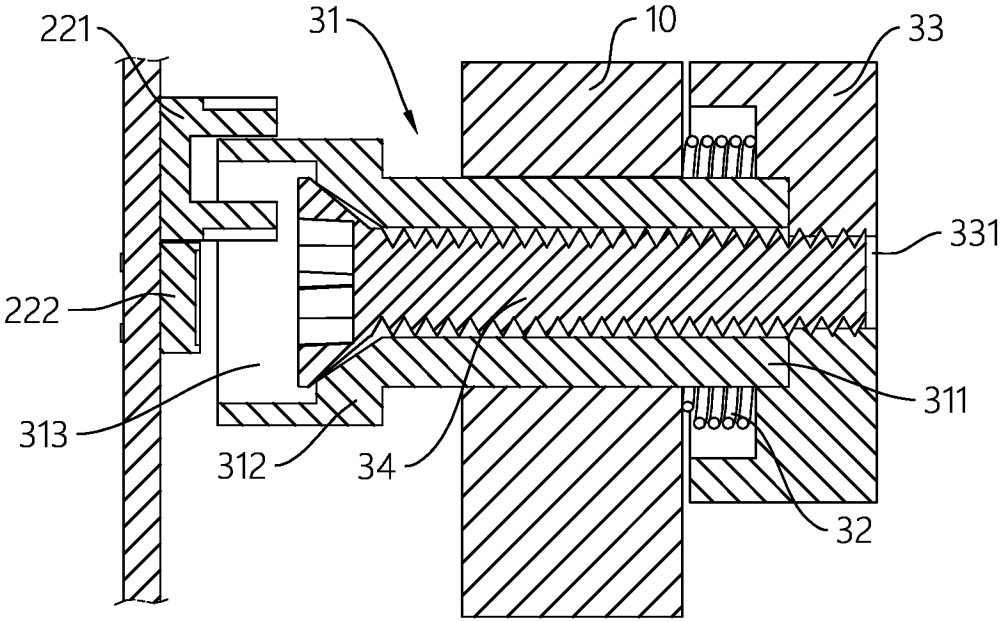
FIG. 7 is a partial cross-sectional view of the electronic shooting training target in FIG. 1.

With reference to FIG. 6 and FIG. 7, when the user shoots and the projectile hits the impact part 33, the impact part 33 is pressurized and compresses the elastic part 32, the hollow rod 31 is displaced towards the direction of the rear side of the target seat 10, until the wall of the slot 313 of the rear end 312 triggers the trigger 22. The triggering member 22 drives the LED luminous part 222 to emit light, and the light is emitted from the light transmissive hole 331 of the impact part 33 through the screw 34, so that the user can immediately know the location of the hit, or the LED luminous part 222 can emit light in advance as the target position display, and the impact part 33 then utilizes the restoring force of the elastic part 32 to return to its initial, pre-pressurized position.

When the impact part 33 does not have the light transmissive hole 331 formed thereon, a target image can be projected onto the impact part 33 by a projection device (not shown in the drawings), versatilely displaying the shooting impacts.

The present invention facilitates users to use recoil simulation toy guns, adopting legal projectiles (such as BB pellets, rubber bullets, etc.) or a variety of non-live-ammunition guns for shooting. In addition to the simulation of manually pressing the trigger of a real gun with real bullets, users can use wired or wireless (Wi-fi) connections to send the hit coordinates back to the tablet or computer for display or storage, which can be used to provide teaching and training data for analysis, and do not need assistant staff to assist the training, saving training manpower and time.

In the aforementioned process, the sensing part 30 adopts a contactless array electronic sensing system to detect the shooting coordinates, and uses a full-color LED luminous part 222 to display the hit point and the target point. Even when subjected to continuous and intensive shootings, the electronic shooting training target can still produce a feedback signal within a very short period of time after a projectile strikes the target, so that the LED luminous part 222 glows and is transmitted to a tablet or a computer for display or calculation, thus enhancing the convenience and practicality of use.

In the aforementioned process, because the impact part 33 has sufficient structural rigidity and is re-useable, it is more environmentally friendly.

In the aforementioned process, the present invention can be used in conjunction with software to add customized training modes to develop relevant application software for specific use. The present invention has the capability of modular combination, which can change the overall size and shape of the target body according to demand.

Figure 8:
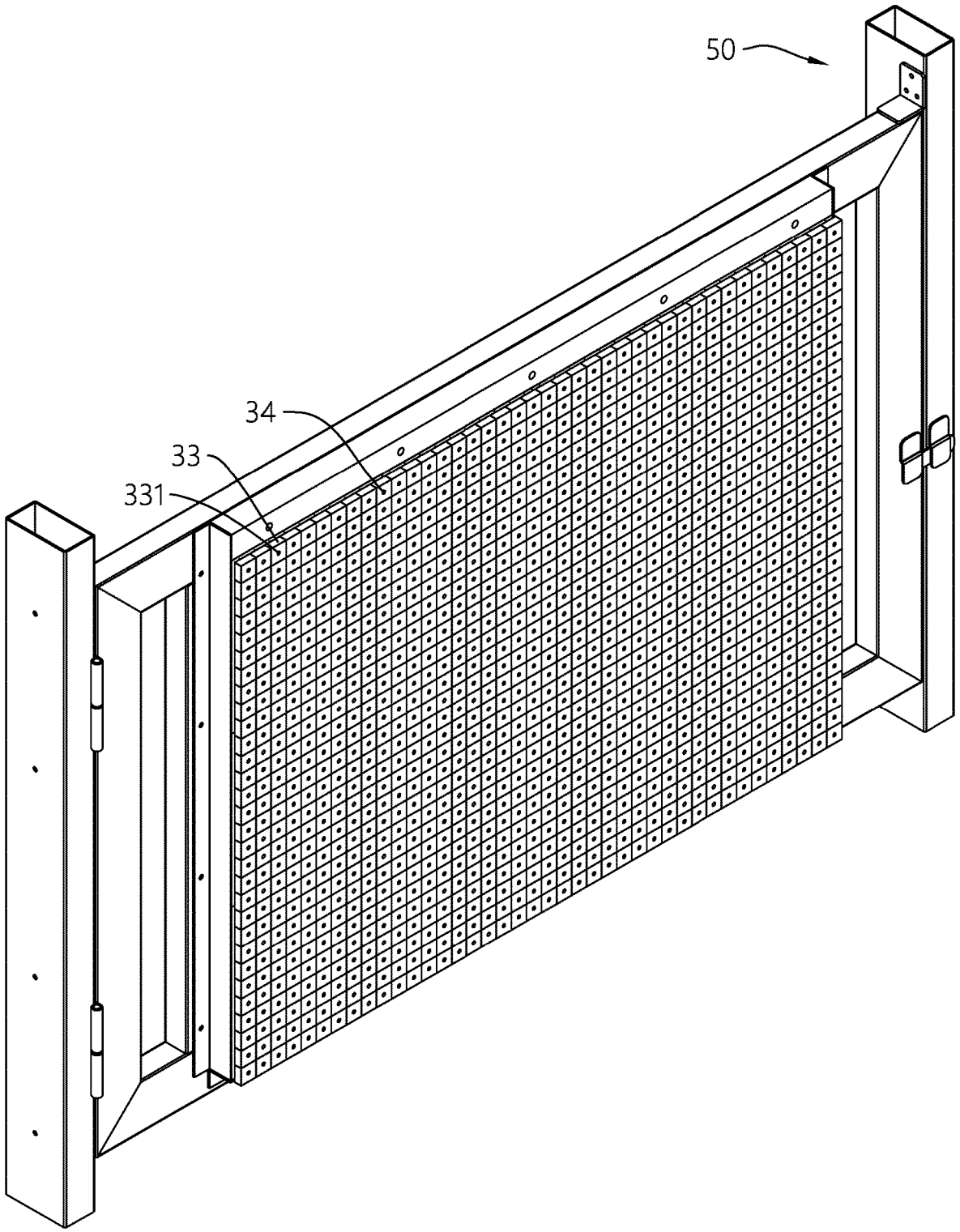
FIG. 8 is a perspective view of the electronic shooting training target in another embodiment in FIG. 1.
Figure 9:
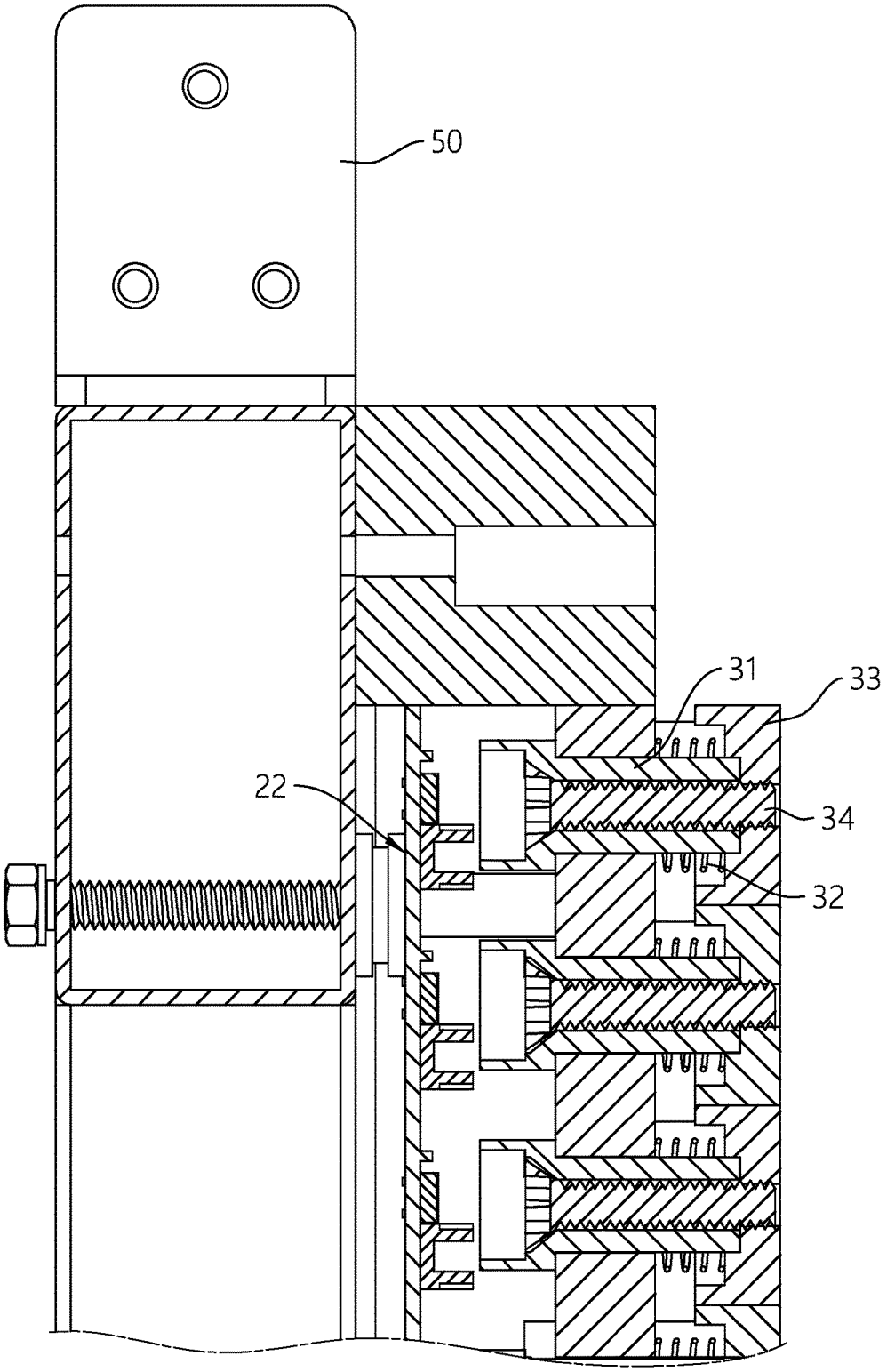
FIG. 9 is a partial side view of the electronic shooting training target in another embodiment in FIG. 1.

Please refer to FIG. 8 and FIG. 9, shown as another embodiment of the present invention. The main difference is that a plurality of the training targets of the present invention can be mounted on a panel holder 50. Precisely, according to user's needs to select the appropriate panel holder 50, then the multiple training targets of the present invention can be assembled on it. The assembly method is conventional so will not be described in detail. In addition to enlarging the shooting area, the means of assembly can also be changed for customization. Another extended application is to project images on the present invention and generate corresponding changes in images and sound effects by using the feedback coordinates of the present invention, increasing the training and entertainment effects.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electronic shooting training target comprising:

a target seat comprising a front side and a rear side, and multiple target holes penetrating through the target seat;

a base plate comprising:

a plate body mounted on the rear side of the target seat and positioned at a distance from the rear side;

multiple triggers, each of the triggers mounted on a surface of the plate body, the surface of the plate body being adjacent to the target seat; and a controller mounted on the plate body and electrically connected to each of the triggers;

multiple sensing assemblies, each of the sensing assemblies including:

a hollow rod mounted through one of the target holes, and each of the hollow rods corresponding in position to a respective one of the triggers;

an elastic part sleeved on one end of the hollow rod and one end of the elastic part abutting the front side of the target seat;

an impact part covering said one end of the hollow rod and abutting another end of the elastic part; and a screw, one end of the screw mounted through another end of the hollow rod and fixed on the impact part.

2. The electronic shooting training target as claimed in claim 1, wherein a light transmissive hole penetrates through the impact part, internal threads are formed in the light transmissive hole, one end of the screw is fixed in the light transmissive hole of the impact part, and the screw is made of a light-conducting material.

3. The electronic shooting training target as claimed in claim 1, wherein the hollow rod comprises a front end and a rear end, the front end and the rear end are opposite ends, and an outer diameter of the front end is smaller than an outer diameter of the rear end.

4. The electronic shooting training target as claimed in claim 2, wherein the hollow rod comprises a front end and a rear end, the front end and the rear end are opposite ends, and an outer diameter of the front end is smaller than an outer diameter of the rear end.

5. The electronic shooting training target as claimed in claim 3, wherein an axial length of the front end is greater than a thickness of the target seat.

6. The electronic shooting training target as claimed in claim 4, wherein an axial length of the front end is greater than a thickness of the target seat.

7. The electronic shooting training target as claimed in claim 5, wherein a slot is concavely formed in an end surface of the rear end, the slot corresponds in position to the trigger, and another end of the screw is located in the slot.

8. The electronic shooting training target as claimed in claim 6, wherein a slot is concavely formed in an end surface of the rear end, the slot corresponds in position to the trigger, and another end of the screw is located in the slot.

9. The electronic shooting training target as claimed in claim 7, wherein each one of the triggers includes a sensor and a light-emitting diode (LED) luminous part, and the sensor, the LED luminous part, the plate body and the controller are electrically connected to each other.

10. The electronic shooting training target as claimed in claim 8, wherein each one of the triggers includes a sensor and a light-emitting diode (LED) luminous part, and the sensor, the LED luminous part, the plate body and the controller are electrically connected to each other.

11. The electronic shooting training target as claimed in claim 9 further comprising a fixation holder including:

a mounting base comprising a storage area, and multiple screw holes formed on opposite sidewall surfaces of the mounting base;

two wall hanging pieces, each one of the wall hanging pieces having multiple hooks and multiple lock holes formed thereon, the two wall hanging pieces respectively locked on the opposite sidewall surfaces of the mounting base;

two support members, each of the two support members having one end pivotally connected to a respective one of the opposite sidewall surfaces of the mounting base; and two angle adjusters, each of the angle adjusters having multiple tooth parts formed thereon, the multiple tooth parts arranged in a direction extending toward two ends of the angle adjuster, one end of each of the angle adjusters pivoted on each of the support members, and the two support members and the two angle adjusters secured by multiple fixtures.

12. The electronic shooting training target as claimed in claim 10 further comprising a fixation holder including:

a mounting base comprising a storage area, and multiple screw holes formed on opposite sidewall surfaces of the mounting base;

two wall hanging pieces, each one of the wall hanging pieces having multiple hooks and multiple lock holes formed thereon, the two wall hanging pieces respectively locked on the opposite sidewall surfaces of the mounting base;

two support members, each of the two support members having one end pivotally connected to a respective one of the opposite sidewall surfaces of the mounting base; and two angle adjusters, each of the angle adjusters having multiple tooth parts formed thereon, the multiple tooth parts arranged in a direction extending toward two ends of the angle adjuster, one end of each of the angle adjusters pivoted on each of the support members, and the two support members and the two angle adjusters secured by multiple fixtures.

13. The electronic shooting training target as claimed in claim 1, wherein the target seat is made of metal.

14. The electronic shooting training target as claimed in claim 12, wherein the target seat is made of metal.

15. The electronic shooting training target as claimed in claim 1, wherein the impact part is made of metal.

16. The electronic shooting training target as claimed in claim 14, wherein the impact part is made of metal.

* * * * *